US006569025B1

(12) United States Patent
Tyler

(10) Patent No.: US 6,569,025 B1
(45) Date of Patent: May 27, 2003

(54) BOWLING BALL

(76) Inventor: Nelson Tyler, 15801 Royal Oak Rd., Encino, CA (US) 90436

( * ) Notice: Subject to any disclaimer, the term of this patent is extended or adjusted under 35 U.S.C. 154(b) by 0 days.

(21) Appl. No.: 10/093,172

(22) Filed: Mar. 7, 2002

(51) Int. Cl.[7] ..... A63H 17/36
(52) U.S. Cl. ..... 473/125; 446/454
(58) Field of Search ..... 473/569, 125; 446/456, 457, 458

(56) References Cited

U.S. PATENT DOCUMENTS

| | | | | | |
|---|---|---|---|---|---|
| 183,549 | A | * | 10/1876 | Dunham | 446/458 |
| 508,558 | A | * | 11/1893 | Tate | 446/458 |
| 624,962 | A | * | 5/1899 | Norton | 446/458 |
| 3,591,177 | A | * | 7/1971 | Skuse | 473/126 |
| 3,798,835 | A | * | 3/1974 | McKeehan | 446/442 |
| 4,058,310 | A | * | 11/1977 | Miettinen | 473/126 |
| 4,099,715 | A | * | 7/1978 | Caplan | 473/126 |
| 4,194,317 | A | * | 3/1980 | Kidd | 446/68 |
| 4,391,224 | A | * | 7/1983 | Adler | 119/707 |
| 4,501,569 | A | * | 2/1985 | Clark et al. | 446/458 |
| 4,541,814 | A | * | 9/1985 | Martin | 446/456 |
| 4,726,800 | A | * | 2/1988 | Kobayashi | 446/458 |
| 5,041,051 | A | * | 8/1991 | Sonesson | 446/456 |
| 5,058,901 | A | * | 10/1991 | Salvino | 473/126 |
| 5,297,981 | A | * | 3/1994 | Maxim et al. | 446/437 |
| 5,439,408 | A | * | 8/1995 | Wilkinson | 446/409 |
| 5,533,921 | A | * | 7/1996 | Wilkinson | 446/409 |
| 5,871,386 | A | * | 2/1999 | Bart et al. | 446/460 |

* cited by examiner

*Primary Examiner*—William M. Pierce
(74) *Attorney, Agent, or Firm*—Joseph F. McLellan

(57) ABSTRACT

A bowling ball having an internal weight whose position along a spin axis is adjustable by operation of a drive means which in turn is operative to rotate a threaded nut sleeve that supports the weight. The rotation is about a threaded, non-rotatable weight shaft that extends along the spin axis. This threadably advances the nut sleeve and the weight along the length of the weight shaft, thereby altering the center of gravity and path of the ball after it is released by the bowler.

10 Claims, 7 Drawing Sheets

40
52
18
20
2
50
38
43
28a
45
38
10
30
42
46
36
44
24
32
56
48
36
43
28b
50
2
54
58
22
40

BOWLING BALL

RELATED APPLICATION

Patent application Ser. No. 09/828,605, now U.S. Pat. No. 6,402,630, Bowling Ball, was filed Apr. 6, 2001 in the name of Nelson Tyler, and its subject matter is incorporated herein by reference.

BACKGROUND OF THE INVENTION

1. Field of the Invention

The present invention relates to a bowling ball having an internal weight whose position is adjustable by a remote controller for altering the path of the ball after it is released by the player.

2. Description of the Prior Art

The conventional way of using a bowling ball is to roll it over the surface of a bowling alley in a direction best calculated to knock over the bowling pins at the far end of the alley. A player has no control over the path of the ball once it is released.

The path of travel of the ball can initially be controlled to a certain extent by the spin or hook a player imparts to the ball on release. Beyond the release point there is nothing a player can do to correct the path of an errant ball, much as the player would like otherwise.

In U.S. Pat. No. 5,058,901 (Salvino) issued Oct. 22, 1981 the inventor observed that when weight is drilled or otherwise removed from the ball to provide thumb and finger holes, the path of the ball was adversely affected by the resulting change in the center of gravity of the ball. According to the patent, this dynamically unbalanced condition could be corrected by locating a rod along the spin axis of the ball. The consequent increase in weight along that axis was designed to reduce the tendency of the ball to wobble after it was released. The axial position of the rod was adjustable between each use to some position that the player felt would be most likely to establish the best path for the ball as it rolled down the alley. It is likely that precise placement of the rod was not easy to achieve since most players "hook" a ball to a varying extent during play and this, together with other variables such as the state of the bowling alley surface, would make it difficult to consistently reach a predictable result. In any event, the arrangement did not provide any dynamic control of the ball. The system amounted to a trial and error procedure in which a player was always trying to match his bowling results with various fixed positions of a rod in the ball. It was not possible to control the path of the ball after it was released.

U.S. Pat. No. 3,591,177 (Skuse) discloses an invention generally similar to the '901 patent just discussed except that a threaded rod was used. Its axial position was adjusted by rotating it along a threaded bore using a screw driver inserted into an access opening from the exterior of the ball. However, during play the position of the rod was fixed. Dynamic adjustment was neither taught nor suggested as being desirable.

A somewhat related arrangement is shown in U.S. Pat. No. 4,058,310 (Miettinen), except that he uses mercury to alter the location of the ball's center of gravity. The mercury is located in one of three elongated chambers that extend radially outwardly from the center of the ball. One or the other of these chambers is filled with the mercury through a three-way valve whose rotated position is changed when a chamber is filled with the desired amount of mercury. The stem of the valve extends outwardly from the center of the ball, and is turned by a key that is inserted through the exterior surface of the ball. The key thus controls which chamber is filled, and to what extent. However, like the other patents discussed above, the position of the valve and other adjustable components are fixed and cannot be changed once the ball has been released for travel down the alley. No dynamic control of the ball path is possible.

A system is disclosed in U.S. Pat. No. 4,501,569 (Clark Jr. et al) for remotely and dynamically controlling the location of the center of gravity of a spherical vehicle. The mechanism includes an elongated axle which extends diametrically along the spin axis of the sphere. The ends of the axle are fixed within the sphere, and a frame which supports the axle is rotatable about the transverse or spin axis of the sphere. An axle gear is fixed to the axle and engaged by a pinion gear. The pinion gear is rotatable by the drive shaft of a motor that is attached to the frame. As a consequence, rotation of the pinion gear rotates the motor and frame about the axle.

Attached to the frame is the inner end of a radially extending pendulum arm whose outer end carries a mass or weight. The frame includes an integral arcuate gear rack that is engaged by the pinion gear of a servo motor which, like the weight, is mounted to the pendulum arm. Rotation of the servo motor thus causes the arcuate gear segment and weight to rotate to one side or the other of the spin axis along which the axle extends.

The servo motor is operable by a remotely located radio transmitter whereby adjustment of the location of the center of gravity of the mass is done dynamically.

A similar result is achieved by the system of U.S. Pat. No. 4,726,800(Kobayashi). A spherical toy includes a center-shaft extending along the spin axis of the toy. The system is controlled by a remotely located radio transmitter that operates a radio receiver within the toy. The receiver operates a battery to energize a servo motor whose output or drive shaft is coupled to a relatively complex connecting structure. This structure is operative to move a direction control means to one side or the other of an axis generally perpendicular to the spin axis of the toy. Such movement adjusts the location of the center of gravity of the toy for dynamically adjusting the path of the toy as it rotates on its spin axis. Although the path axis of the toy is controll remotely by radio signals from a radio transmitter, the structure which uses these control signals to relocate the center of gravity is complex and consequently expensive and time consuming to manufacture and maintain.

In my copending patent application Ser. No. 09/828,605, the direction or path axis of a bowling ball is dynamically adjusted as it travels down a bowling alley by moving an internal weight along the spin axis of the ball. This adjusts the location of the center of gravity of the ball and thus the path of the ball. The internally threaded weight is prevented from rotating about the externally threaded weight shaft, but the weight shaft is rotatable so that it can threadably move the weight along the shaft axis. A disclosure of this system is included in the present application to facilitate understanding of the structural differences between such a system and the system of the present invention, and particularly the utilization in this system of a weight shaft that is fixed against rotation.

SUMMARY OF THE INVENTION

Thus, according to the present invention the weight shaft is non-rotatable. In one embodiment the motor is made integral with the weight and both are axially slidable upon interior walls of the bowling ball. However, they are constrained against rotation by their engagement with the walls.

A motor gear on the output shaft of the motor rotates a drive gear which is frictionally engaged with a threaded nut sleeve. The nut sleeve is threadably carried by the weight shaft and is rotatably supported within the weight by rotatable bearings. When the friction between the nut sleeve and the drive gear is sufficiently great, rotation of the drive gear rotates the nut sleeve such that the nut sleeve rotates and threadably advances the nut sleeve and the weight along the length of the non-rotatable weight shaft, thereby adjusting the center of gravity of the ball. However, when such friction is low, the nut sleeve will slip and not be rotated by the drive gear. Adjustment of the degree of frictional engagement is provided by a clutch spring washer that is disposed between the drive gear and the nut sleeve.

This function of the clutch spring washer is useful if the nut sleeve has been rotated in one direction or the other along the length of the weight shaft to an end stop on the shaft. The torque of the drive gear then becomes insufficient to rotate the nut sleeve, and the clutch spring washer then slips, thereby preventing damage which might occur if the nut sleeve could not slip and is forcibly urged against the fixed end stop.

In another embodiment of the present system the motor is a standard rotor-stator motor in which the stator is integral with the weight and both the stator and the weight are constrained against rotation by engagement of the weight with the interior walls of the bowling ball, but are axially slidable over the walls. The rotor is fixed to a nut sleeve which is threaded onto the weight shaft. When the stator is energized, it cannot rotate but the rotor and nut sleeve are rotatable about the fixed weight so that the nut sleeve can move axially along the length of the weight shaft to adjust the center of gravity of the ball.

In certain situations use of those embodiments which include a fixed weight shaft is advantageous compared to the embodiments disclosed in my copending patent application which employ a rotatable weight shaft.

Other objects and features of the present invention will become apparent from the following more detailed description taken in conjunction with the accompanying drawings.

DESCRIPTION OF THE PREFERRED EMBODIMENTS

Figure 1:
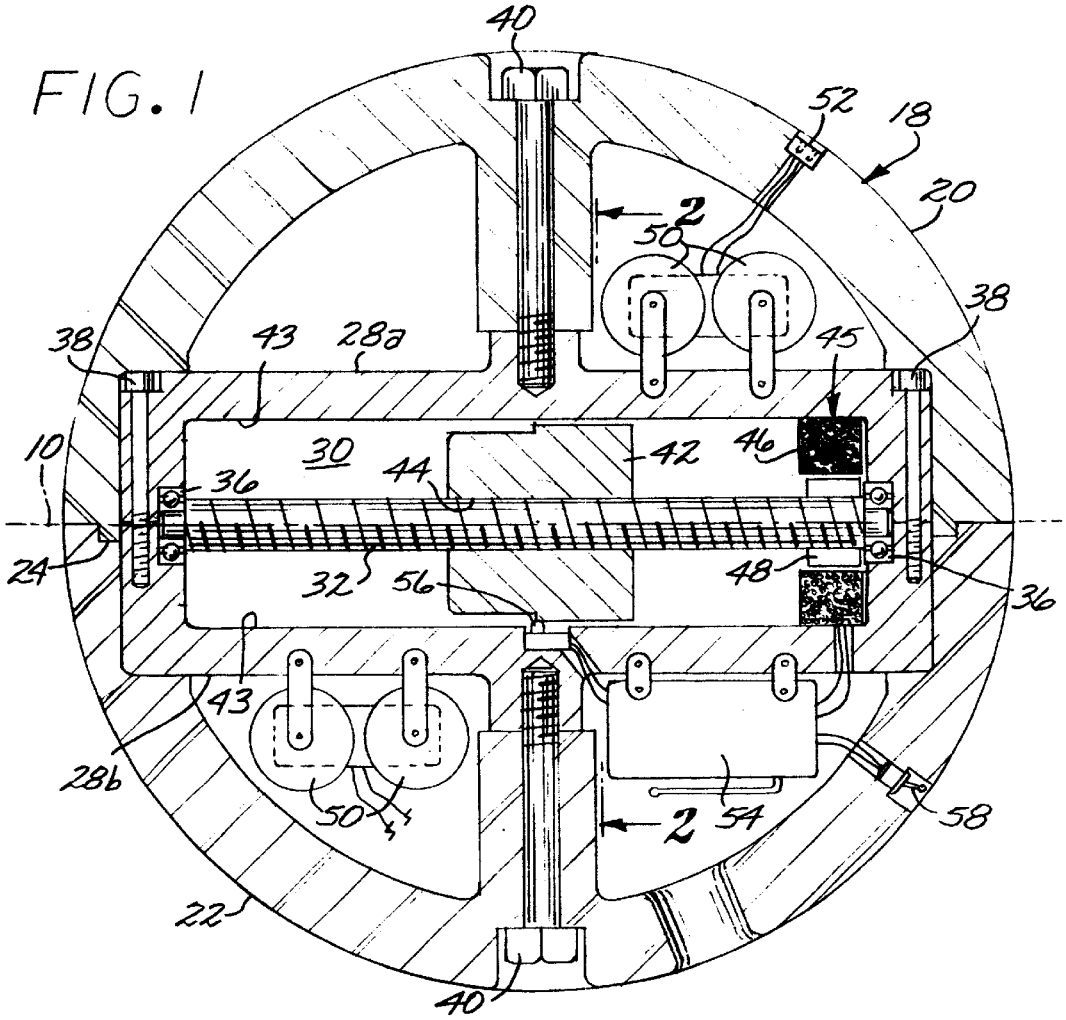
FIG. 1 is an enlarged longitudinal cross section of the bowling ball, illustrating the pair of hemispherical sections that are joined together to form a spherical bowling ball having a hollow interior for housing a frame that supports the weight and the motor shaft.
Figure 2:
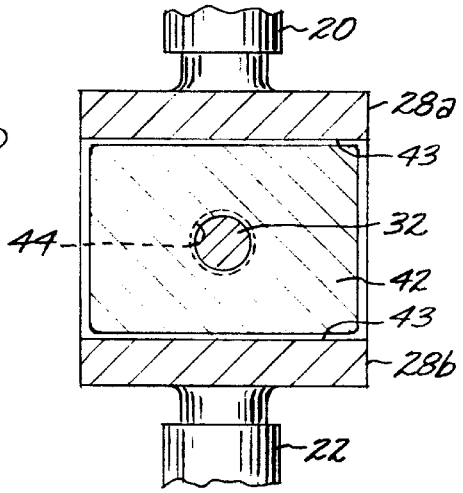
FIG. 2 is an enlarged cross section taken along the line 2—2 of FIG. 1.

Referring now to the drawings, and particularly to FIGS. 1–6, a typical spherical bowling ball is illustrated that is adapted to be rolled down a bowling alley or lane (not shown), and hooked so that it follows a curved path to the pins. However, the ball is modified according to the present invention by omitting the usual straight and radially inwardly directed thumb and finger holes which allow a player to hook the ball. Instead, holes are provided which enable a player to throw the ball along a relatively straight path.

FIGS. 1–6 and descriptions of these figures are set forth in my copending patent application Ser. No. 09/828,605. In this application no claim is made to the structures disclosed. The figures are included in this application only because it is believed that this will facilitate an understanding of the structures disclosed and described in this application.

Figure 6:
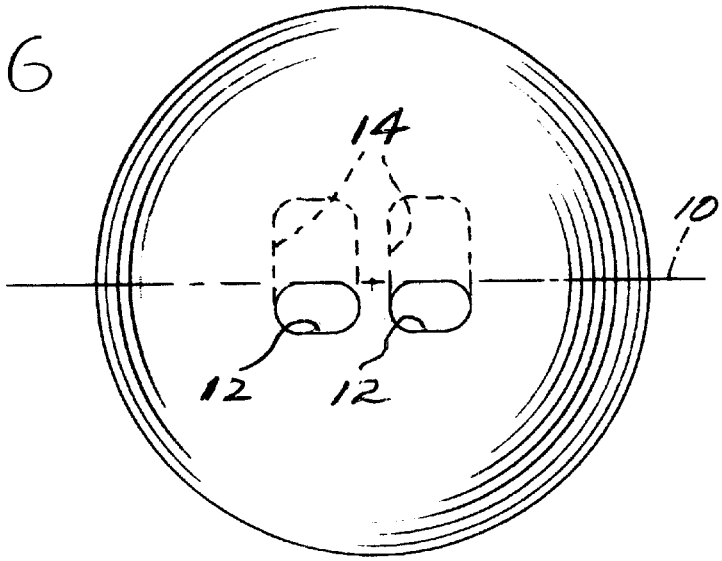
FIG. 6 is a side elevational view of the present bowling ball, illustrating in dotted outline the location and form of one arrangement of finger holes.
Figure 7:
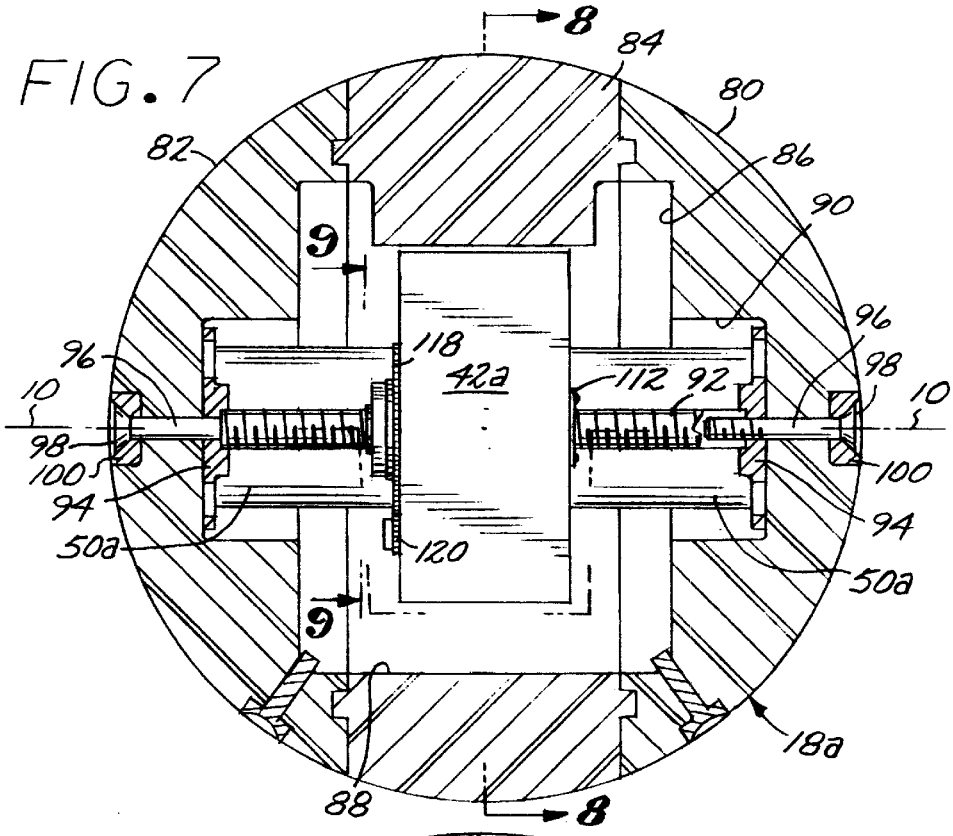
FIG. 7 is a cross section of the hollow interior of another form of ball in which the ends of the motor shaft are fixed to the interior wall of a three piece spherical ball so that the shaft is non-rotatable, with the weight being integral with the motor.
Figure 8:
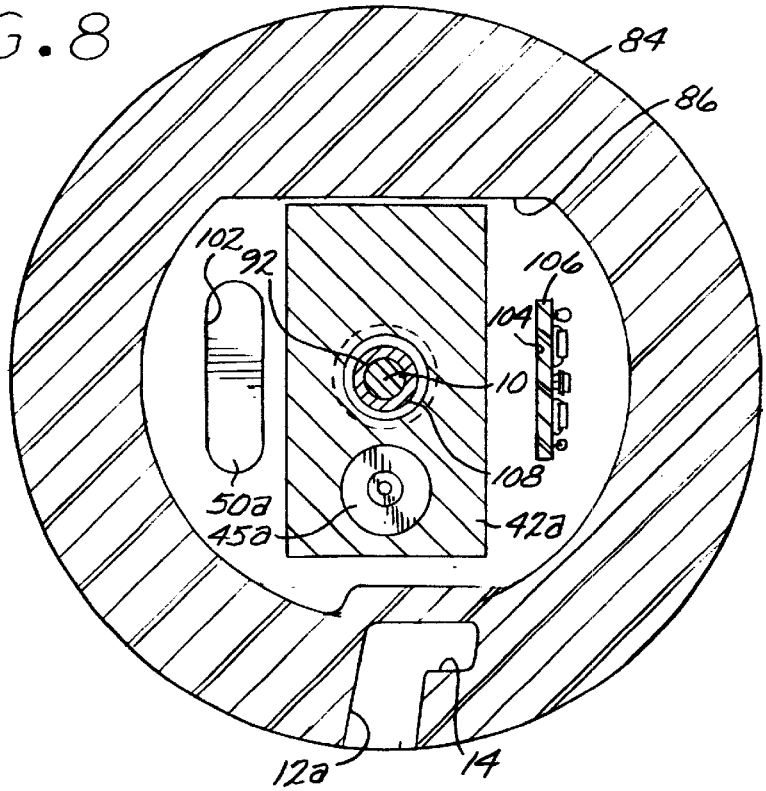
FIG. 8 is a view taken along the line 8—8 of FIG. 7.
Figure 9:
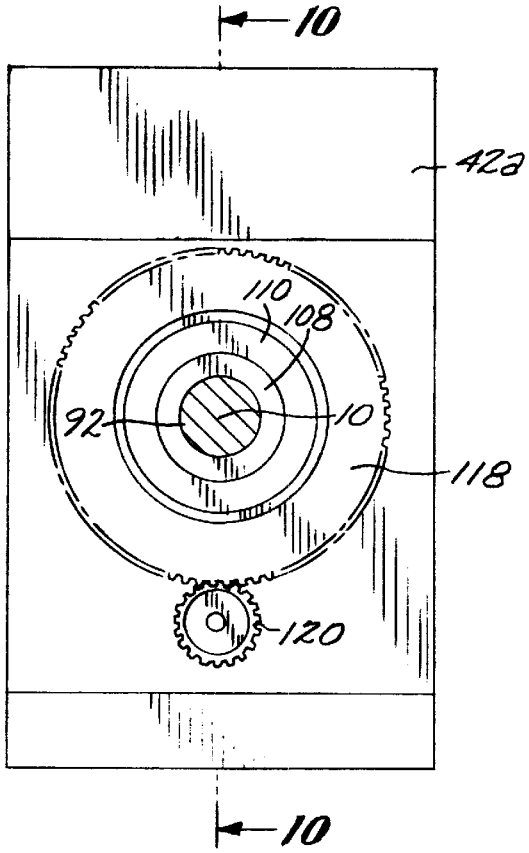
FIG. 9 is a view taken along the line 9—9 of FIG. 7.

Both of the embodiments of FIGS. 1–6 show a substantially horizontal, transversely oriented spin axis 10 about which the ball rotates as it travels down the bowling alley. FIG. 6 illustrates a particular form and arrangement of finger holes used in one of these embodiments, and preferred for use in other ball embodiments of the present application.

As seen, the finger holes 12 are located on a centerline that extends generally parallel to the spin axis 10, and each is directed generally inwardly and forwardly to form a shelf or ledge 14. This has been found to produce satisfactory results, but any of various other forms and locations of holes can be used if desired.

The spherical outer portions 18 of the ball are defined by a pair of hemispheres 20 and 22 which form an internal cavity that includes a hollow weight chamber 30. An externally threaded weight 42 is rotatably supported at its ends by bearings 36 carried by the frame.

An internally threaded weight 42 is rotatably mounted to the shaft 32 and includes a flat outer face that slidably engages a complemental face 43 of the frame to prevent rotation of the weight when the weight shaft 32 is rotated, while permitting axial movement of the weight.

In the first embodiment of the system described in my copending application, as seen in FIG. 1, the drive means or motor used comprises a stator 46 fixed to the frame 28, and a rotor 48 carried by the weight shaft 32 for rotating the weight shaft 32. Energization of the stator windings in one direction will rotate the weight shaft 32 in one direction, while energization of the stator windings in the opposite direction will oppositely rotate the weight shaft 32.

The stator is coupled to batteries 50 mounted externally of the frame within a hollow interior or spaces adjacent the frame. Energization of the stator to move the weight 42 in one direction or the other is controlled by a radio receiver 54 mounted to the frame 28 and connected by suitable leads to the stator 46, batteries 50, and to a microswitch or optical sensor 56.

When the stator 46 has been energized for a predetermined time interval to move the weight in one direction or the other, the sensor is operative to energize the stator 46 until the weight 42 is re-centered within the frame. This enables the weight to then be moved in either direction from the re-centered position, rather than from an extreme position near one end or the other of the weight shaft 32. Location of the weight in the centered position is desirable when the ball is released and begins to spin or roll.

The radio receiver 54 is operable by radio signals transmitted by a remotely located hand held transmitter 60. This allows a single player to throw the ball and thereafter control the ball direction. Alternatively, it allows one player of a two player team to throw the ball, with the second player operating the transmitter 60. The throwing member of the team tries to release the ball in such a way that there is little or no hooking which could cause the ball to deviate from a straight path toward the pins. To the extent that it does not follow a straight path, the task of the other team member is to correct this by operating the transmitter 60 in such a way that the position of the weight 42 on the weight shaft is adjusted to adjust the location of the center of gravity of the weight.

Figure 3:
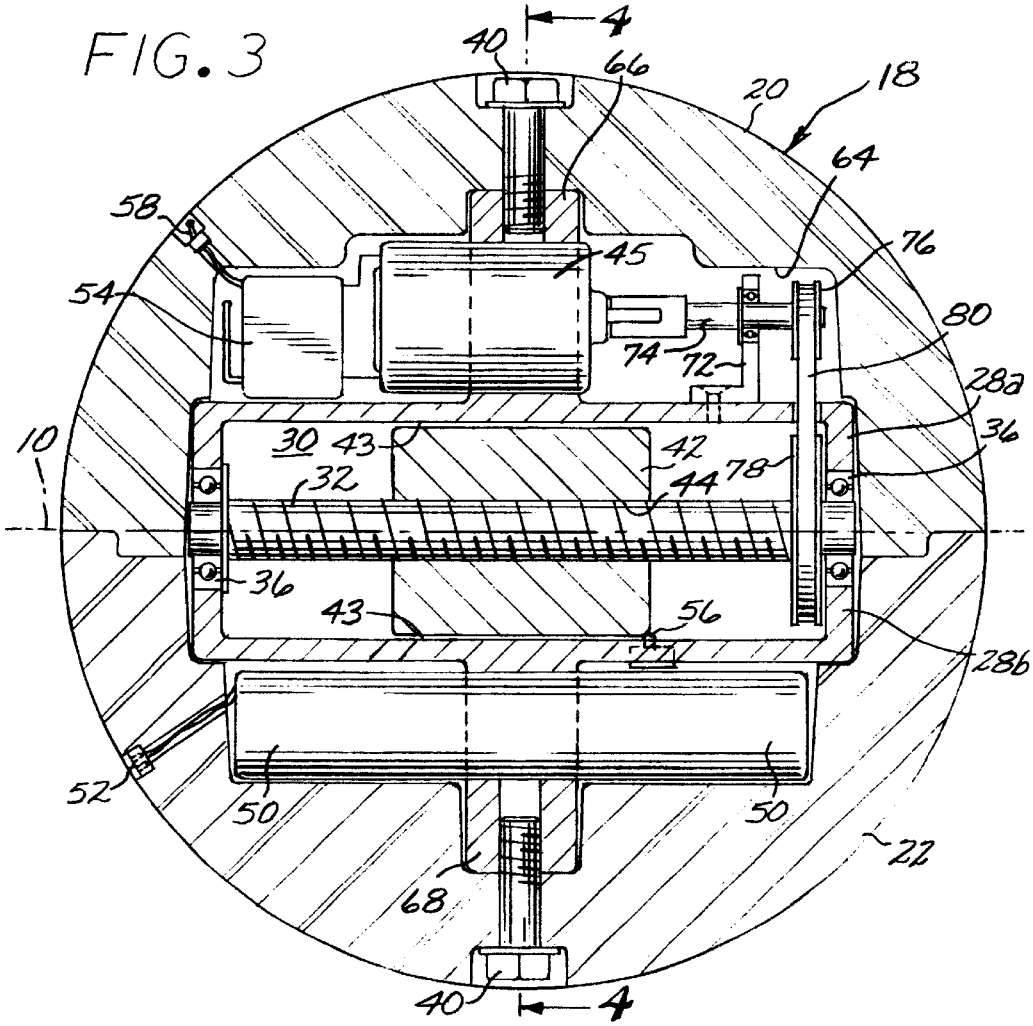
FIG. 3 is an enlarged cross section of the nut sleeve, drive motor and clutch arrangement.
Figure 4:
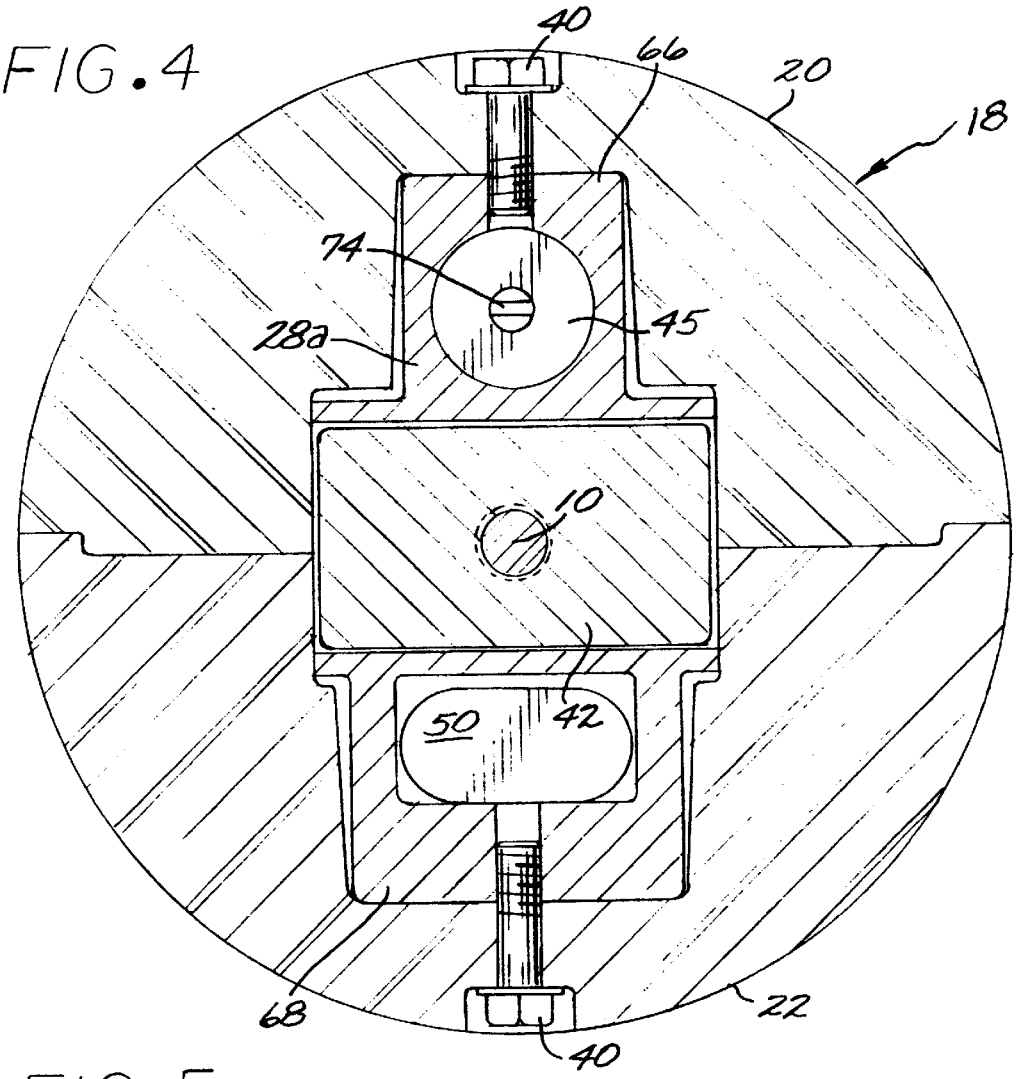
FIG. 4 is a view of the ball taken along the line 4—4 of FIG. 3.
Figure 5:
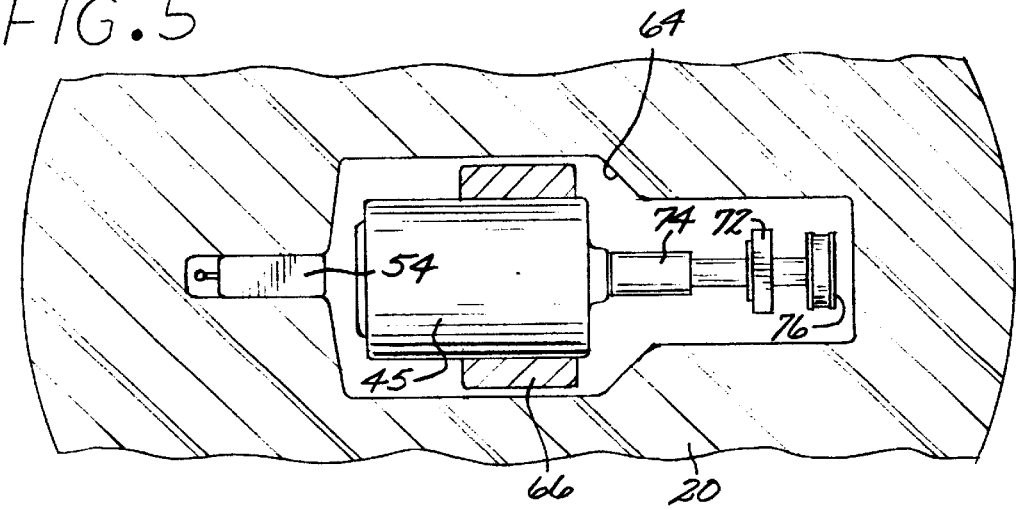
FIG. 5 is a top plan view of the motor, pulley and pulley belt assembly that is housed within a cavity of the upper one of the hemispherical sections of the ball, with the adjacent ball structure shown in cross section.

The second embodiment of the copending patent application, shown in FIG. 3, is substantially the same as that shown in FIG. 3 except that the motor 45 for rotating the weight shaft 32 is located externally of the frame, and the motor and associated components are located within cavities on opposite sides of the weight 42.

A pulley 76 on the end of the motor shaft 74 is coupled to a belt 80 to rotate a pulley that is mounted on the weight shaft 32. This second embodiment is different from the first embodiment primarily in the type of motor and its external location to simplify and reduce manufacturing costs.

Coming now to the embodiments of the present invention, as seen in FIGS. 7–10, they are different in important respects compared to the just described embodiments of my copending application. Where the structures are identical they are assigned the same numbers as are used in the patent application; where they are not identical but similar in function they are assigned the same number but with a lower case letter; and where the parts are substantially different they are assigned a new number.

In FIGS. 7–10 a spherical bowling ball 18*a* is illustrated which comprises end caps 80 and 82 that are joined to opposite sides of a central ring 84 so that their outer surfaces form the spherical outer surface of the ball. Their inner surfaces define a hollow interior 86 which includes a weight chamber 88 and a battery cavity 90 for holding batteries 50*a*. An externally threaded weight shaft 92 extends parallel to the spin axis 10 of the ball, and its opposite ends are closely received within circular support brackets 94 which are suitably attached to the end walls of the battery cavity 90.

The threaded ends of a pair of threaded bolts 96 are disposed within smaller diameter threaded bores in the ends of the weight shaft 92. The bolt heads 98 are received within circular inserts 100 that are seated within complemental cavities in the end caps 80 and 82, respectively. This arrangement securely holds the weight shaft 92 in position and fixes or constrains it against any rotation, while also performing the important function of clamping the end caps 80 and 82 to the central ring 84. This assembly is much simpler and less expensive to manufacture compared to that set forth in my copending patent application Ser. No. 09/828,605.

The end caps 80 and 82 include receiver slots 102 which closely receive the ends of the batteries 50*a* to hold them in place without any need for fasteners. Likewise, the caps 80 and 82 included receiver slots 104 which closely receive the ends of a circuit board 106 that mounts electronic components which are connected to the batteries 50*a,* the radio receiver (not shown) which receives the control signals from the handheld remote transmitter, and the micro switch (not shown) associated with the weight re-centering system.

Use of the circumferentially continuous central ring 84 allows the ball to roll about is spin axis 10 without any annoying thumping sounds which occur in a two piece ball when the ball rolls across the joint between the two pieces.

Figure 10:
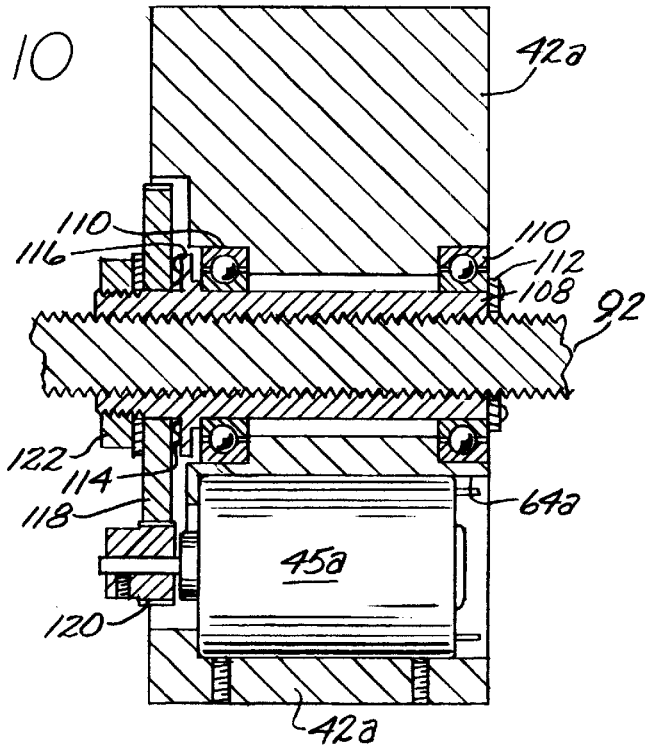
FIG. 10 is a view taken along the line 10—10 of FIG. 9.

A balance weight 42*a* includes a motor chamber 64*a* having an open end through which a motor 45*a* is mounted, as best seen in FIG. 10, so that the motor 45*a* forms an integral weight component of the weight 42*a*.

The system omits any frame or frame parts like the frame halves 28*a* and 28*b* used in the embodiment of FIG. 1. This simplifies the ball structure and reduces the weight of the bowling ball.

An internally threaded nut sleeve 108 is mounted upon the externally threaded weight shaft 92, and a pair of end bearings 110 are disposed between the weight 42*a* and the nut sleeve 108, as best seen in FIG. 10. A bearing plate 112 is screw fastened to one end of the nut sleeve 108 to hold the adjacent bearing 110 in position. The opposite bearing 110 is held in position by a circumferential flange 116 of the nut sleeve 108.

The gear 118 is rotatable by a motor drive gear 120 which is fixedly attached to the output shaft of the motor. As best seen in FIG. 10, a clutch adjust nut 122 is threaded onto the adjacent end of the nut sleeve 108. It can be tightened or loosened to adjust the frictional force developed by the clutch spring 114 when the nut sleeve drive gear 118 is rotated relative to the flange 116 of the nut sleeve 108. The adjustment is such that normally there is sufficient frictional force to rotate the nut sleeve 108. However, when the nut sleeve 108 reaches an end travel limit, that is, too close to one of the ends of the weight shaft 92, the clutch spring 114 will slip so that the gears 120 and 118 will not be forcibly jammed together, as they would be should the re-centering micro switch (not shown) fail to operate.

The major advantages provided by the embodiment of FIGS. 7–10 are that the motor 45*a* is carried by the weight 42*a,* thereby utilizing the weight of the motor 45*a* as part of the weight 42*a* in a compact arrangement; the cooperating gears 118 and 120 are simpler and less expensive than pulley and belt arrangements and provide a straightforward step-down of the higher motor RPM to the lower nut sleeve RPM; the weight shaft 92 is fixed against rotation; and the clutch spring washer 114 prevents overruns of the nut sleeve 108 that could damage elements such as the drive gears and motor.

Figure 11:
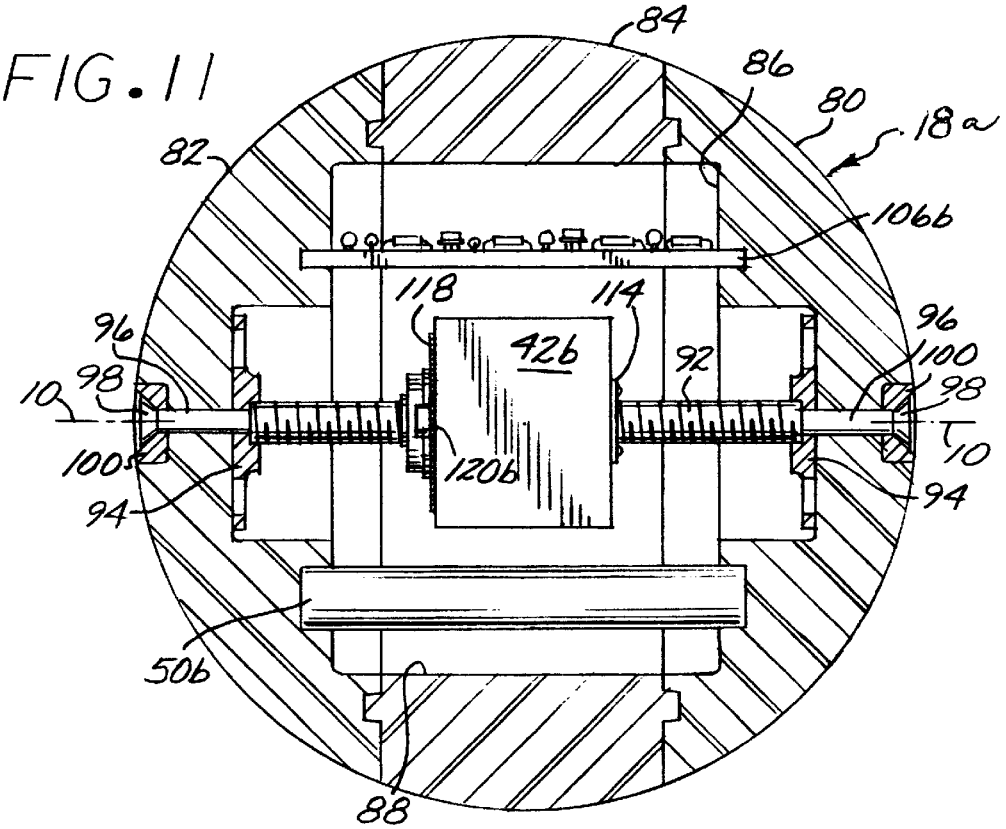
FIG. 11 is a view similar to FIG. 7, but showing another embodiment similar to that of FIG. 7 in which the end sections of the spherical ball receive and support the opposite ends of a battery pack without the use of fasteners.
Figure 12:
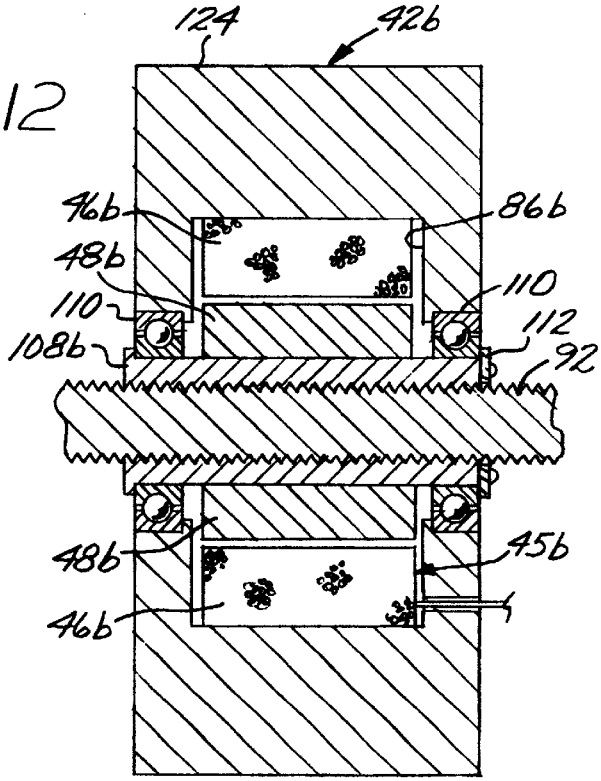
FIG. 12 is a transverse cross sectional view of an embodiment of a bowling ball which employs a rotor-stator motor similar to that of FIG. 1, but wherein the motor elements are housed within the axially movable weight.

FIGS. 11 and 12 illustrate another embodiment which in some ways is a combination of the embodiment of FIGS. 7–10 and that of FIG. 1, particularly in that it employs a motor 45*b* having a stator 46*b* and a rotor 48*b*. The stator 46*b* and rotor 48*b* are both carried within the hollow interior 86*b* of the weight 42*b,* thereby providing added weight to augment the weight of the weight 42*b*. The arrangement is desirably compact, which is evident in a comparison of FIGS. 7 and 11.

Although not shown, a face 124 of the weight 42*b* engages a complemental inner surface of an inner wall of the central ring 84 so that rotation of the nut sleeve 108*b* will not rotate the weight 42*b,* but will instead threadably move it axially along the threaded weight shaft 92.

Energization of the stator 46*b* to move the weight 42*b* in one direction or the other is controlled by a radio receiver (not shown) which is operated by radio signals from a remotely located hand held transmitter (not shown), as in the other embodiments, and as described in more detail in my copending patent application. As previously indicated, this makes it possible for an individual bowler or one member of a bowling team to release the ball for rotation about its spin axis 10. The bowler or other team member then adjusts the center of gravity of the ball by operating the remote transmitter to properly locate the internal weight.

While preferred embodiments of the invention have been illustrated and described, it will be apparent that various modifications and changes can be made without departing from the spirit and scope of the invention.

What is claimed is:

1. A bowling ball comprising:

a sphere having end caps and a central portion defining a hollow interior;

a threaded weight shaft having a longitudinal shaft axis, the weight shaft being mounted to the end caps to fix the weight shaft against rotation about the shaft axis;

threaded sleeve means mounted to the fixed weight shaft for threadable movement along the shaft axis upon rotation of the sleeve means;

a weight means located adjacent the weight shaft;

bearing means supporting the weight means, the weight means being mounted to the sleeve means and constraining the sleeve means against axial movement relative to the weight means, the bearing means allowing rotation of the sleeve means about the shaft axis independently of the weight means;

surfaces on the weight means and on the interior of the sphere, and engageable to constrain the weight means from rotating about the shaft axis, while enabling axial movement of the weight means and the sleeve means along the shaft axis upon rotation of the sleeve means about the shaft axis, the direction of the movement corresponding to the direction of rotation of the sleeve means; and drive means selectively operable to rotate the sleeve means.

2. A bowling ball according to claim 1 having a spin axis about which the ball rotates as it rolls down a bowling alley, the central portion having a circumferentially continuous, unjointed outer surface for substantially constant contact with the surface of the alley during rotation of the ball down the alley about its spin axis.

3. A bowling ball according to claim 1 wherein the sleeve means comprises a threaded nut sleeve on the weight shaft.

4. A bowling ball according to claim 1 wherein the ends of the weight shaft include threaded bores, and wherein elongated bolts are mounted to the end caps and are threaded into the threaded bores to fix the weight shaft against rotation, and to fix the end caps to the center portion.

5. A bowling ball according to claim I wherein the drive means comprises a motor located in the hollow interior and forming part of the weight means.

6. A bowling ball according to claim 5 wherein the weight means includes an internal cavity, and the motor comprises a stator in the cavity mounted to the weight means, and a rotor in the cavity mounted to the sleeve means.

7. A bowling ball according to claim 1 and further comprising elongated battery means located in the hollow interior for energizing the drive means, and wherein the end caps include recessed openings to slidably receive the ends of the battery means to secure them in position and to assemble the end caps to the central portion.

8. A bowling ball according to claim 5, wherein the motor is fixed to the weight means, and including a driven gear mounted to the sleeve means, and a drive gear on the motor for rotating the driven gear and the sleeve means to threadably move the sleeve means along the fixed weight shaft.

9. A bowling ball according the claim 8 wherein the sleeve means includes a circumferentially extending flange located adjacent the driven gear; and a clutch spring washer located between the flange and the driven gear in frictional engagement therewith, the clutch spring washer being movable from a position of relatively low frictional engagement insufficient to rotate the sleeve means upon rotation of the drive gear, to a position of relatively high frictional engagement sufficient to rotate the sleeve means upon rotation of the drive gear, which threadably moves the sleeve means and weight means along the fixed weight shaft.

10. A bowling ball according to claim 1 and including a radio receiver in the sphere electrically coupled to the drive means and to a remote transmitter for selectively operating the radio receiver to operate the drive means and move the weight longitudinally along the weight shaft.

* * * * *